US005612773A

United States Patent [19]

Berkes et al.

[11] Patent Number: 5,612,773

[45] Date of Patent: Mar. 18, 1997

[54] INTERMEDIATE TRANSFER MEMBER

[75] Inventors: John S. Berkes, Webster; Rasin Moser, Fairport, both of N.Y.

[73] Assignee: Xerox Corporation, Stamford, Conn.

[21] Appl. No.: 516,843

[22] Filed: Aug. 18, 1995

[51] Int. Cl.[6] ..... G03G 15/16; G03G 15/20

[52] U.S. Cl. ..... 399/307; 399/318

[58] Field of Search ..... 355/271, 272, 355/273, 277, 279, 282, 285, 290, 274

[56] References Cited

U.S. PATENT DOCUMENTS

| | | | |
|---|---|---|---|
| 3,392,667 | 7/1968 | Gassel et al. | 101/170 |
| 3,955,530 | 5/1976 | Knechtel | 118/60 |
| 4,348,098 | 9/1982 | Koizumi . | |
| 4,453,820 | 6/1984 | Suzuki | 355/279 |
| 4,518,976 | 5/1985 | Tarumi et al. | 355/279 X |
| 4,588,279 | 5/1986 | Fukuchi . | |
| 4,708,460 | 11/1987 | Langdon | 355/271 |
| 5,047,808 | 9/1991 | Landa et al. | 355/277 |
| 5,233,397 | 8/1993 | Till | 355/279 |
| 5,408,302 | 4/1995 | Manzer et al. | 355/285 |
| 5,493,373 | 2/1996 | Gundlach et al. | 355/279 |

*Primary Examiner*—Sandra L. Brase
*Attorney, Agent, or Firm*—John M. Kelly

[57] ABSTRACT

A transfusing member having a compression layer comprised of a highly conformable, low durometer material with a low surface tension. The transfusing member forms a first transfer nip characterized by a first pressure with a photoreceptive surface and a second transfer nip characterized by a second pressure, which is of the same order of magnitude as the first pressure, with a backup roller.

3 Claims, 2 Drawing Sheets

INTERMEDIATE TRANSFER MEMBER

FIELD OF THE INVENTION

This invention relates to electrophotographic printing machines which incorporate an intermediate transfer member.

BACKGROUND OF THE INVENTION

Electrophotographic marking is a well known and commonly used method of copying or printing original documents. Electrophotographic marking is performed by exposing a light image representation of a desired document onto a substantially uniformly charged photoreceptor. In response to that light image the photoreceptor discharges so as to create an electrostatic latent image of the desired document on the photoreceptor's surface. Toner particles are then deposited onto the latent image so as to form a toner image. That toner image is then transferred from the photoreceptor onto a substrate such as a sheet of paper. The transferred toner image is then fused to the substrate using heat and/or pressure. The surface of the photoreceptor is then cleaned of residual developing material and recharged in preparation for the production of another image.

The foregoing generally describes a black and white electrophotographic printing machine. Electrophotographic printing can also produce color images by repeating the above process for each color of toner that is used to make the color image. For example, the charged photoreceptive surface may be exposed to a light image which represents a first color, say black. The resultant electrostatic latent image can then be developed with black toner particles to produce a black toner layer which is subsequently transferred and fused onto a substrate. The process can then be repeated for a second color, say yellow, then for a third color, say magenta, and finally for a fourth color, say cyan. If the toner layers are placed in a superimposed registration the desired composite color toner image is formed on the substrate.

The color printing process described above superimposes the various color toner layers directly onto a substrate. Another electrophotographic color printing system makes use of an intermediate transfer member. In such systems successive toner layers are transferred in superimposed registration from the photoreceptor onto the intermediate transfer member. Only after the composite toner image is formed on the intermediate transfer member is that image transferred and fused onto the substrate.

The most common developing materials are dry powder toners. Dry powder toners are comprised of not only toner particles but also of carrier granules. The toner particles triboelectrically adhere to the carrier granules until the toner particles are attracted onto the latent image. An alternative to dry powder developing materials are liquid developers. Liquid developers, also referred to as liquid inks, have a liquid carrier into which toner particles are dispersed. When developing with liquid developers both the toner particles and the liquid carrier are advanced into contact with the electrostatic latent image.

Some electrophotographic printing machine use both liquid developers and an intermediate transfer member. In such machines the transfer of a toner layer from the photoreceptor to the intermediate transfer member, hereinafter referred to as the first transfer, is usually performed such that a first nip pressure is developed by the contact of the photoreceptor with the intermediate transfer member. Furthermore, the transfer of the composite color toner image from the intermediate transfer member to the substrate, hereinafter referred to as the second transfer, usually takes place such that a second nip pressure is developed by the contact of the intermediate transfer member with a backup roller. During image transfer the substrate is inserted between the intermediate transfer member and the backup roller. The combination of the second nip pressure and heat from an external source causes the color toner image to fuse with the substrate.

For example, U.S. Pat. No. 5,047,808 entitled, "Image Transfer Apparatus Including A Compliant Transfer Member," issued 10 Sep. 1991 to Landa et al, describes an electrophotographic printing machine which develops first and second nip pressures as described above. Landa et al. teaches transferring a toner layer from an imaging bearing surface onto an intermediate transfer member at a first pressure which causes the intermediate transfer member to deform to a first degree, and then the transfer of the toner image from the intermediate transfer member onto a substrate at a second pressure which causes the intermediate transfer member to deform to a second degree, wherein the second pressure exceeds the first pressure by a first multiple, and wherein the second deformation degree exceeds the first deformation degree by a second multiple, and wherein the second multiple is substantially less than the first multiple.

Systems as taught in Landa et al. are advantageous since the low pressure first transfer provides for a good transfer of the toner layer onto the intermediate transfer member without excessive wear of the photoreceptor while the high pressure second transfer ensures good image transfer onto the substrate even when the substrate's surface is rough, such as with uncoated papers. However, the high second pressure during the second transfer can cause belt tracking problems since the substrate tends to steer the intermediate transfer member during transfer. This steering increases the wear of the intermediate transfer member and reduces the quality of the transferred image.

Therefore, transfusing systems which avoid belt tracking problems yet which provide good image transfer onto relatively rough substrates would be beneficial.

Various approaches have been devised to produce multicolor color copies. The following United States Patents may be useful references:

U.S. Pat. No. 3,392,667 Patentee: Cassel et al. Issued: Jul. 16, 1968

U.S. Pat. No. 3,955,530 Patentee: Knechtel Issued: May 11, 1976

U.S. Pat. No. 4,348,098 Patentee: Koizumi Issued: Sep. 7, 1982

U.S. Pat. No. 4,588,279 Patentee: Fukuchi et al. Issued: May 13, 1986

The disclosures of the above-identified patents may be briefly summarized as follows:

U.S. Pat. No. 3,392,667 discloses a plurality of print cylinders having gravure engravings on their peripheries. Powder feed hoppers having rotating brushes apply powder to the print cylinders. The powder images from the print cylinders are transferred to an offset roller in superimposed registration with one another. The resultant powder image is then transferred from the offset roller to paper or sheeting.

U.S. Pat. No. 3,955,530 discloses a color image forming electrophotographic printing machine. Different color developers are used to develop the latent images recorded on the photoreceptive drum. Each developed image is sequentially transferred to an intermediate transfer drum. A cleaning blade is used to clean the photoreceptive drum between developing different color developers. The complete image is transferred from the intermediate drum to a copy sheet.

U.S. Pat. No. 4,348,098 discloses an electrophotographic copying apparatus which uses a transfix system. In a transfix system, the developed image is transferred from the photoconductive member to an intermediate roller. The intermediate roller defines a nip with a fixing roller through which the copy sheet passes. The developed image is then transferred from the intermediate roller to a copy sheet. The developing unit of the copying apparatus may either be a dry or wet type.

U.S. Pat. No. 4,588,279 discloses an intermediate transfer member that has a dry toner image transferred thereto from the surface of a toner image forming member. The toner image is then transferred from the transfer member to a recording paper.

SUMMARY OF THE INVENTION

The present invention provides for electrophotographic printing machines comprised of an intermediate transfer member which receives a toner layer from a photoreceptor at a first transfer nip having a first pressure and which transfers a toner image onto a substrate at a second transfer nip having a second pressure, wherein the first and second pressures are substantially similar. By substantially similar it is meant that they are of the same order of magnitude. Beneficially the first pressure is about 10 to 15 pounds per square inch (PSI).

Printing machines according to the principles of the present invention include a photoreceptor having a photoconductive surface, a charging station for charging that photoconductive surface to a predetermined potential, at least one exposure station for exposing the photoconductive surface to produce an electrostatic latent image on the photoconductive surface, at least one developing station for depositing a toner layer on the latent image, and a transfusing module having an intermediate transfer member which contacts the photoreceptor at a first transfer pressure. The transfusing module further includes a backup roller which contacts the intermediate transfer member at a second transfer pressure which is substantially similar to the first transfer pressure. The intermediate transfer member is comprised of a highly conformable, low durometer material having a low surface tension. Beneficially the intermediate transfer member is comprised of silicone rubber.

BRIEF DESCRIPTION OF THE DRAWINGS

Other aspects of the present invention will become apparent as the following description proceeds and upon reference to the drawings, in which.

In the drawings like numbers designate like elements.

DETAILED DESCRIPTION OF THE PREFERRED EMBODIMENTS

Figure 1:
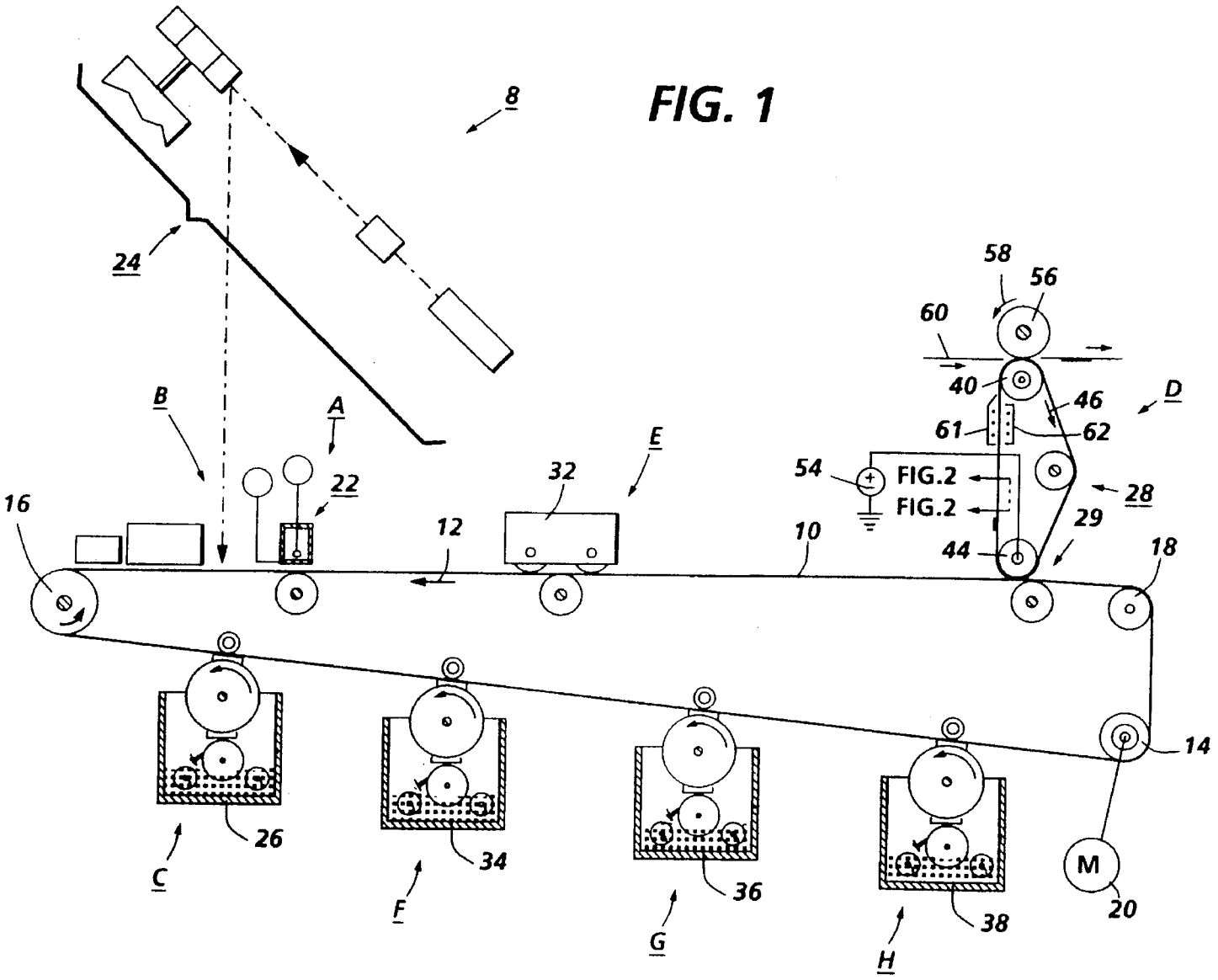
FIG. 1 schematically illustrates an electrophotographic printing machine which incorporates the principles of the present invention.

FIG. 1 illustrates an electrophotographic printing machine 8 that reproduces an original document. Although the principles of the present invention are well suited for use in such reproduction machines, they are also well suited for use in other printing devices. Therefore it should be understood that the present invention is not limited to the particular embodiment illustrated in FIG. 1 or to the particular application shown therein.

The printing machine 8 includes a charge retentive device in the form of an Active Matrix (AMAT) photoreceptor 10 which has a photoconductive surface and which travels in the direction indicated by the arrow 12. Photoreceptor travel is brought about by mounting the photoreceptor about a drive roller 14 and two tension rollers, the rollers 16 and 18, and then rotating the drive roller 14 via a drive motor 20.

As the photoreceptor moves each part of it passes through each of the subsequently described process stations. For convenience, a single section of the photoreceptor, referred to as the image area, is identified. The image area is that part of the photoreceptor which is operated on by the various process stations to produce toner layers. While the photoreceptor may have numerous image areas, since each image area is processed in the same way a description of the processing of one image area suffices to explain the operation of the printing machine.

As the photoreceptor 10 moves, the image area passes through a charging station A. At charging station A a corona generating scorotron 22 charges the image area to a relatively high and substantially uniform potential, for example about −500 volts. While the image area is described as being negatively charged, it could be positively charged if the charge levels and polarities of the other relevant sections of the copier are appropriately changed. It is to be understood that power supplies are input to the scorotron 22 as required for the scorotron to perform its intended function.

After passing through the charging station A the now charged image area passes to an exposure station B. At exposure station B the charged image area is exposed to the output of a laser based output scanning device 24 which illuminates the image area with a light representation of a first color image, say black. That light representation discharges some parts of the image area so as to create a first electrostatic latent image.

After passing through the exposure station B, the now exposed image area passes through a first development station C. At the first development station C a negatively charged development material 26, which is comprised of black toner particles, is advanced to the image area. The development material is attracted to the less negative sections of the image area and repelled by the more negative sections. The result is a first toner layer on the image area. While the development material 26, and all of the subsequently described development materials, could be either powder or liquid, the principles of the present invention are particularly useful with liquid development materials. If the development material is a powder toner then the toner image is substantially pure toner particles. However, if the development material is liquid the toner image is comprised of toner particles and a liquid carrier.

After passing through the first development station C the image area is advanced to a transfusing module D. That transfusing module includes a positively charged transfusing member 28, which may be a belt as illustrated in FIG. 1 or a drum, which forms a first nip 29 with the photoreceptor. That nip is characterized by a first pressure between the photoreceptor 10 and the transfusing member 28. The negatively charged toner layer on the photoreceptor is attracted onto the positively charged transfusing member. Beneficially the first pressure is rather small, for example about 10 to 15 PSI.

After the first toner image is transferred to the transfusing member 28 the image area passes to a cleaning station E.

The cleaning station E removes any residual development material remaining on the photoreceptor 10 using a cleaning brush contained in a housing 32.

After passing through the cleaning station E the image area repeats the charge-expose-develop-transfer-clean sequence for a second color of developer material (say yellow). Charging station A recharges the image area and exposure station B illuminates the recharged image area with a light representation of a second color image (yellow) to create a second electrostatic latent image. The image area then advances to a second development station F which deposits a second negatively charged development material 34, which is comprised of yellow toner particles, onto the image area so as to create a second toner layer. The image area and its second toner layer is then advanced to the transfusing module D where the second toner layer is transferred onto the transfusing member 28.

The image area is again cleaned by the cleaning station E. The charge-expose-develop-transfer-clean sequence is then repeated for a third color (say magenta) of development material 36 using development station G, and then for a fourth color 38 (cyan) of development material using development station H.

Turning our attention to the transfusing module D, the transfusing member 28 is entrained between a transfuse roller 40 and a transfer roller 44. The transfuse roller is rotated by a motor, which is not shown, such that the transfusing member rotates in the direction 46 in synchronism with the motion of the photoreceptor 10. The synchronism is such that the various toner images are registered after they are transferred onto the transfusing member 28.

Figure 2:
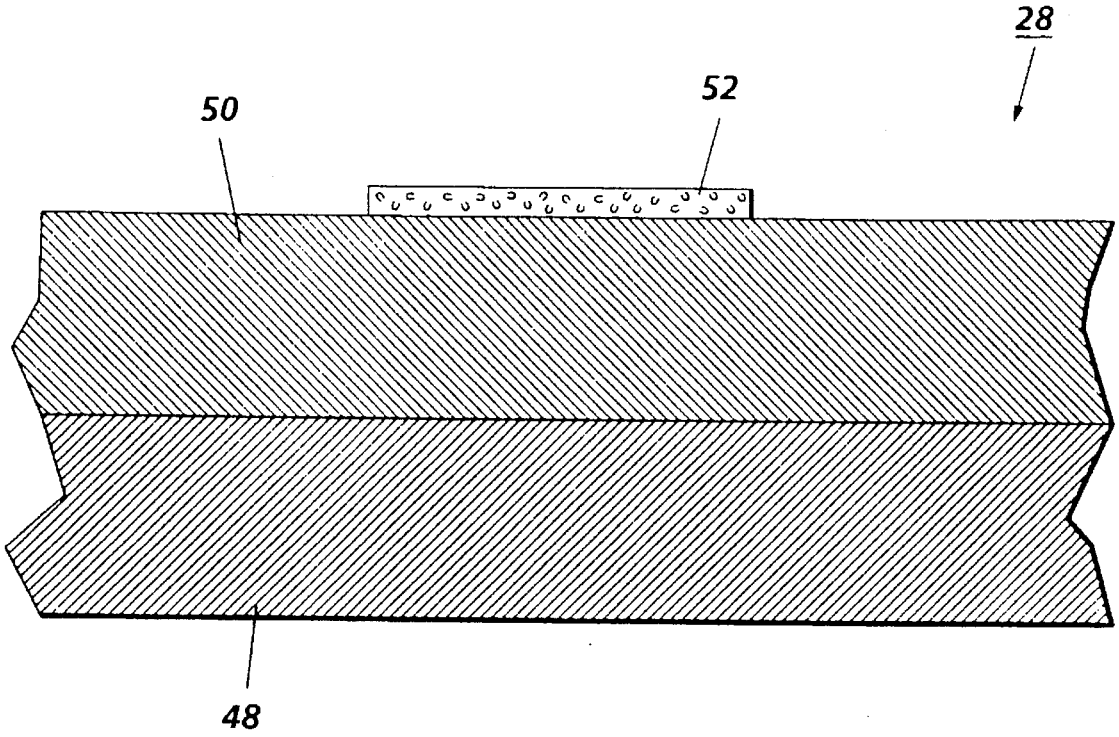
FIG. 2 illustrates a cut-away view of the intermediate transfer member of FIG. 1.

The construction of the transfusing member is shown in more detail in FIG. 2, which is a cut-away view of the section 2—2 in FIG. 1. The transfusing member 28 is a seamless assembly of two layers, a semiconductive polyimide substrate layer 48 and a compression layer 50. The use of a seamless belt construction is important in that a seamed belt would require synchronization to prevent the seam from interfering with the image. The compression layer is comprised of a highly conformable, low durometer material having a low surface tension. Beneficially, the compression layer is a silicone rubber compound.

Referring once more to FIG. 1, the transfusing module D also includes a source 54 of electrical bias which connects to the transfer roller 44. That bias assists in transferring the electrostatic images.

Still referring to FIG. 1, the transfusing module D also includes a backup roller 56 which rotates in the direction 58. The backup roller is beneficially located opposite the transfuse roller 40. The backup roller cooperates with the transfuse roller to form a second nip having a second pressure which is substantially the same as the first pressure. The second nip acts as a transfusing zone. When a substrate 60 passes through the transfusing zone the toner layer on the compression layer is heated by a combination of heat either from a radiant preheater 61 or conductive heat from a conductive heater 62 and heat from the transfuse roller 40. The combination of heat and pressure fuses the composite toner layer onto the substrate.

As previously mentioned the compression layer 50 is comprised of a highly conformable, low durometer material having a low surface tension. The high compressibility of the compression layer 50 enables the compression layer, and thus the toner layer, to conform to the substrate 60. This enables high efficiency toner layer transfer to most substrates, even those whose surface finish is relatively coarse. The low durometer characteristic assists in achieving similar first and second pressures. Finally, the low surface tension characteristic provides for ready release of the toner layers onto the substrate. Silicone rubber compounds generally fulfill the required characteristics of the compression layer.

It is to be understood that while the figures and the above description illustrate the present invention, they are exemplary only. Others who are skilled in the applicable arts will recognize numerous modifications and adaptations of the illustrated embodiments which will remain within the principles of the present invention. Therefore, the present invention is to be limited only by the appended claims.

What is claimed:

1. An electrophotographic printing machine comprised of:

a photoreceptor having a photoconductive surface;

a charging station for charging said photoconductive surface to a predetermined potential;

an exposure station tier exposing the photoconductive surface to produce an electrostatic latent image on the photoconductive surface;

a developing station for depositing a toner layer on the photoconductive surface;

a biased transfusing member having a compression layer comprised of a highly conformable, low durometer material having a low surface tension, said transfusing member contacting said photoreceptor at a first nip which is characterized by a first transfer pressure such that the bias, the first transfer pressure, and the surface tension of the material comprising the transfusing member induces said toner layer to be transferred to said transfusing member; and a backup roller contacting said transfusing member at a second nip which is characterized by a second transfer pressure which is of the same order of magnitude as said first transfer pressure, said backup roller for assisting in transfusing said toner layer on said transfusing member onto a substrate.

2. The electrophotographic printing machine according to claim 1 wherein said compression layer is comprised of silicone rubber.

3. The electrophotographic printing machine according to claim 1 further comprising a semiconductive substrate layer in thermal communication with said compression layer.

* * * * *